US007607765B2

(12) United States Patent
Iriguchi

(10) Patent No.: US 7,607,765 B2
(45) Date of Patent: Oct. 27, 2009

(54) LIQUID-DROPLET JETTING APPARATUS

(75) Inventor: Akira Iriguchi, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 492 days.

(21) Appl. No.: 11/654,819

(22) Filed: Jan. 18, 2007

(65) Prior Publication Data

US 2007/0176977 A1 Aug. 2, 2007

(30) Foreign Application Priority Data

Jan. 19, 2006 (JP) ..... 2006-011225

(51) Int. Cl.
*B41J 2/045* (2006.01)

(52) U.S. Cl. ..... 347/72

(58) Field of Classification Search ..... 347/68, 347/70–72

See application file for complete search history.

(56) References Cited

U.S. PATENT DOCUMENTS 5,402,159 A * 3/1995 Takahashi et al. ..... 347/9

6,595,628 B2 7/2003 Takagi et al.

FOREIGN PATENT DOCUMENTS

JP 2002-254634 9/2002
JP 2004291543 10/2004

* cited by examiner

*Primary Examiner*—An H Do
(74) *Attorney, Agent, or Firm*—Reed Smith LLP

(57) ABSTRACT

A liquid-droplet jetting apparatus is provided with a cavity unit in which nozzles and pressure chambers are formed; and a piezoelectric actuator which includes active portions which deforms when a drive voltage is applied thereto. In the apparatus, the active portions are deformed to change the volume of the pressure chambers to thereby jet a liquid in the pressure chambers from the nozzles. The active portions are grouped into a plurality of groups which are different in the length in the longitudinal direction of the active portions. Active portions with a greater length have a greater width, and active portions with a smaller length have a smaller width. Accordingly, in the liquid-droplet jetting apparatus in which the active portions are grouped into the jetting groups, drive voltages can be made substantially same with respect to all the jetting groups.

11 Claims, 9 Drawing Sheets

Fig. 6 wb=wc=160 μm

| HEAD No. | Bk | CL | VOLTAGE DIFFERENCE (V) |
|---|---|---|---|
| 1 | 22.0 | 21.6 | 0.4 |
| 2 | 21.6 | 21.1 | 0.5 |
| 3 | 21.9 | 21.4 | 0.5 |
| 4 | 22.2 | 21.3 | 0.9 |
| 5 | 21.8 | 21.3 | 0.5 |
| 6 | 21.6 | 21.0 | 0.6 |
| 7 | 22.0 | 21.1 | 0.9 |
| 8 | 22.3 | 21.5 | 0.8 |
| 9 | 21.5 | 20.7 | 0.8 |
| 10 | 22.1 | 21.3 | 0.8 |
| 11 | 21.8 | 20.9 | 0.9 |
| 12 | 21.6 | 21.1 | 0.5 |
| 13 | 22.0 | 21.2 | 0.8 |
| 14 | 22.6 | 22.1 | 0.5 |
| 15 | 22.9 | 22.9 | 0.0 |
| 16 | 23.2 | 22.9 | 0.3 |
| AVERAGE | | | 0.6 |

Fig. 7 wb=160 μm
wc=154 μm

| HEAD No. | Bk | CL | VOLTAGE DIFFERENCE (V) |
|---|---|---|---|
| 1 | 22.8 | 22.9 | −0.1 |
| 2 | 23.0 | 23.4 | −0.4 |
| 3 | 23.0 | 23.2 | −0.2 |
| 4 | 22.4 | 22.8 | −0.4 |
| 5 | 22.7 | 22.8 | −0.1 |
| 6 | 21.7 | 21.6 | 0.1 |
| 7 | 21.0 | 21.2 | −0.2 |
| 8 | 21.5 | 21.5 | 0.0 |
| 9 | 21.9 | 21.7 | 0.2 |
| 10 | 21.3 | 21.4 | −0.1 |
| 11 | 21.4 | 21.3 | 0.1 |
| 12 | 22.5 | 22.5 | 0.0 |
| 13 | 21.8 | 21.6 | 0.2 |
| 14 | 21.9 | 22.0 | −0.1 |
| 15 | 21.9 | 21.9 | 0.0 |
| 16 | 21.6 | 21.6 | 0.0 |
| 17 | 22.2 | 22.1 | 0.1 |
| 18 | 22.1 | 22.2 | −0.1 |
| 19 | 22.4 | 22.3 | 0.1 |
| 20 | 22.2 | 22.3 | −0.1 |
| 21 | 22.2 | 22.7 | −0.5 |
| 22 | 22.2 | 22.3 | −0.1 |
| 23 | 22.0 | 22.3 | −0.3 |
| 24 | 22.0 | 22.3 | −0.3 |
| 25 | 22.2 | 22.3 | −0.1 |
| 26 | 21.9 | 22.0 | −0.1 |
| AVERAGE | | | −0.1 |

LIQUID-DROPLET JETTING APPARATUS

CROSS REFERENCE TO RELATED APPLICATION

The present application claims priority from Japanese Patent Application No. 2006-011225 filed on Jan. 19, 2006, the disclosure of which is incorporated herein by reference in its entirety.

BACKGROUND OF THE INVENTION

1. Field of the Invention

The present invention relates to a liquid-droplet jetting apparatus which jets (discharges) a droplet of a liquid from a cavity unit by displacing an active portion in a piezoelectric actuator.

2. Description of the Related Art

The liquid-droplet jetting apparatus is exemplified by an ink-jet printer and the like. Japanese Patent Application Laid-open No. 2004-291543, discloses an ink-jet head which applies a jetting pressure from a piezoelectric actuator to a cavity unit provided with a nozzle to thereby jet an ink droplet from the nozzle. In Japanese Patent Application Laid-open No. 2004-291543 (FIGS. 5 and 7), the cavity unit is formed in a substantially flat shape and has a plurality of pressure chambers formed on one surface of the cavity unit and a plurality of nozzles formed on the other surface of the cavity unit; and in the cavity unit, ink-flow channels are formed for the nozzles respectively, each of the ink channels ranging from one of the pressure chambers and reaching up to one of the nozzles.

The piezoelectric actuator has a plurality of piezoelectric layers, a plurality of individual electrodes corresponding to the pressure chambers respectively, and common electrodes. Portions, of each of the piezoelectric layers, each of which is sandwiched between the common and individual electrodes, form active portions which are deformable by a drive voltage applied between the individual and common electrodes. The piezoelectric actuator is stacked on the one surface of the cavity unit in a state that the piezoelectric actuator covers the pressure chambers. In this case, the piezoelectric actuator is arranged on the one surface of the cavity unit so that the active portions correspond to the pressure chambers respectively.

In the ink-jet head constructed in such a manner, the active portions are deformed to thereby change the volume of the pressure chambers in which the ink is filled, so that the ink is jetted from the nozzles corresponding to the pressure chambers respectively. In order that droplet of the ink (ink droplets) are jetted at a predetermined speed, it is necessary to change the volume of the pressure chambers by a predetermined amount.

SUMMARY OF THE INVENTION

In a liquid-droplet jetting apparatus, it is desired that an amount in which the liquid is jetted (jetting amount) and a speed at which the liquid is jetted (jetting speed) are changed in accordance with the nozzles. For example, in an ink-jet head provided with a plurality of color inks for performing color recording, it is sometimes desired that the jetting amount is changed among the nozzles in accordance with the color of the inks jetted through the nozzles. Specifically, in case of a black ink mainly used for text (character) recording, there is a demand to increase the recording speed by making the jetting amount to be great per one droplet. On the other hand, in case of color inks such as yellow, magenta and cyan inks, there is a demand to make the jetting amount to be small per one droplet for the purpose of performing the recording with high vividness and resolution.

For the purpose of changing the jetting amount in accordance with the color of the inks, there is a method in which a value of the drive voltage (drive voltage value), applied to the active portions, is changed corresponding to the ink colors, thereby making the volume change applied by the active portions to the pressure chambers to be different among the pressure chambers. With this method, however, there is need to set a plurality of drive voltage values in advance in a controller (driver IC or the like) which controls the drive voltage, and thus creates a problem that the cost for the controller is increased.

An object of the present invention is that, in a liquid-droplet jetting apparatus in which active portions are formed to be grouped into a plurality of jetting groups, drive voltages applied to active portions, belonging to the jetting groups respectively, are made to be substantially same among all the jetting groups.

According to a first aspect of the present invention, there is provided a liquid-droplet jetting apparatus which jets droplets of liquids onto an object, the apparatus including: a cavity unit having a plurality of nozzles, and a plurality of pressure chambers which correspond to the nozzles respectively and which are elongated in a first direction; and a piezoelectric actuator stacked on the cavity unit to cover the pressure chambers, and having a plurality of active portions which are arranged corresponding to the pressure chambers respectively, which change volume of the pressure chambers respectively by being applied with a predetermined drive voltage, and which are elongated in the first direction; wherein the active portions, the nozzles and the pressure chambers are grouped into a first jetting group and a second jetting group; an active portion, among the active portions, included in the first jetting group has a length in the first direction which is greater than that of another active portion included in the second jetting group, and has a length in a second direction, orthogonal to the first direction, which is greater than that of the another active portion included in the second jetting group; and a drive voltage applied to the active portion included in the first jetting group is same as a drive voltage applied to the another active portion included in the second jetting group.

According to the first aspect of the present invention, the active portions are adjusted so that the active portions in the first and second jetting groups, respectively, are mutually different in the length (length in the first direction) and the width (length in the second direction), to thereby make the drive voltages, applied to the active portions in the jetting groups respectively, to be substantially same with each other. Accordingly, in the controller (driver IC or the like) which controls the drive voltages, there is no need to set the drive voltage value in advance separately for each of the jetting groups, and thus the cost of the controller can be reduced. Note that it is desired that the width of the active portion in the first jetting group is greater by about 3% than the width of the active portion in the second jetting group.

In the liquid-droplet jetting apparatus of the present invention, a property of a liquid, among the liquids, jetted from the first jetting group and a property of another liquid, among the liquids, jetted from the second jetting group may be different; and the first jetting group and the second jetting group may have mutually different jetting conditions.

According to the liquid-droplet jetting apparatus of the present invention, for example, even when the first and second jetting groups jet the liquids which are different in the property of the liquid (viscosity, surface tension, color and the like) and/or even when the first and second jetting groups have different jetting conditions (nozzle diameter, jetting amount, jetting speed and the like), the length and width of the active portions are adjusted so that the drive voltages applied to these jetting groups, respectively, are substantially same, thereby making it possible to reduce the cost for the controller.

In the liquid-droplet jetting apparatus of the present invention, a nozzle, among the nozzles, belonging to the first jetting group may jet a liquid, among the liquids, at a speed substantially same with a speed at which another liquid, among the liquids, is jetted from another nozzle belonging to the second jetting group.

In this case also, the cost for producing the controller can be reduced. In addition, the first and second jetting groups jet the liquids from the nozzles thereof, respectively, at a substantially same speed. Therefore, when the liquid-droplet jetting apparatus is an ink-jet head, it is possible to prevent a recording state (landing positions) of the ink droplets jetted from the nozzles from varying or becoming non-uniform between the jetting groups, thereby making it possible to improve the quality of the recorded images and/or letters.

In the liquid-droplet jetting apparatus of the present invention, the first and second jetting groups may be set to jet the liquids in different jetting amounts respectively; and an active portion, among the active portions, belonging to one of the first and second jetting groups which performs jetting in a greater jetting amount among the jetting amounts, may have the length in the first direction and the length in the second direction greater than those of another active portion belonging to the other of the first and second jetting groups which performs the jetting in a smaller jetting amount among the jetting amounts.

In this case, in one of the jetting groups which performs the jetting in the greater jetting amount than the other jetting group which performs the jetting in the smaller amount, an active portion belonging thereto has the length (length in the first direction) and the width (length in the second direction) both greater than those of another active portion belonging to the other of the jetting groups. Accordingly, the area of the active portion belonging to the one jetting group is greater than the active portion belonging to the other jetting group. This makes it possible to make, even when same drive voltages are applied to the one jetting group and the other jetting group respectively, the total deformation amount by which the active portion is deformed in the one jetting group to be greater than in the other jetting group. Therefore, the jetting amount is made to be greater in the one jetting group with the greater jetting amount.

In the liquid-droplet jetting apparatus of the present invention, a diameter of a nozzle, among the nozzles, belonging to one of the first and second jetting groups which performs the jetting in the greater amount, may be greater than a diameter of another nozzle belonging to the other of the first and second jetting groups which performs the jetting in the smaller jetting amount.

In this case, by changing the diameter of the nozzles in accordance with the jetting groups, the jetting amount in which the liquid is jetted is made to be different in accordance with the jetting groups. For example, when the liquids are inks, this makes it possible to increase the quality of recorded images and/or letters.

In the liquid-droplet jetting apparatus of the present invention, a liquid, among the liquids, jetted from a nozzle among the nozzles belonging to one of the first and second jetting groups, which performs the jetting in the greater jetting amount, may be a pigment ink; and another liquid, among the liquids, jetted from another nozzle belonging to the other of the first and second jetting groups, which performs the jetting in the smaller jetting amount, may be a dye ink.

In this case, the jetting group which performs the jetting in the greater jetting amount is a group which jets the pigment ink; and the other jetting group which performs the jetting in the smaller jetting amount is a group which jets the dye ink. In other words, the jetting amount in which the pigment ink is jetted is made greater than the jetting amount in which the dye ink is jetted. Accordingly, even when the pigment ink is harder to blur than the dye ink, it is possible to achieve a satisfactory balance between an area at which the dye ink is spread (blurred) and an area at which the pigment ink is spread (blurred) when the dye and pigment inks are landed on the recording medium.

In the liquid-droplet jetting apparatus of the present invention, the pigment ink may be a black ink; and the dye ink may be a color ink.

In this case, since the pigment ink is the black ink and the dye ink is the color ink, it is possible to improve balance between the black ink and the color ink or inks other than the black ink, in terms of areas in each of which one droplet of one of the black ink and other color ink(s) spreads on the recording medium.

In the liquid-droplet jetting apparatus of the present invention, the piezoelectric actuator may have a plurality of stacked piezoelectric layers. In this case, it is possible to increase the deformation of the piezoelectric actuator, thereby making it possible to suppress the drive voltages applied to the active portions to be low.

In the liquid-droplet jetting apparatus of the present invention, a length in the first direction of a pressure chamber, among the pressure chambers, belonging to the first jetting group may be greater than that of another pressure chamber belonging to the second jetting group. In this case, for example, with respect to a liquid such as black ink used in a great amount, a pressure chamber having a great volume can be used.

The liquid-droplet jetting apparatus of the present invention may be an ink-jet head which jets droplets of inks. In this case, there is no need to set drive voltages according to the jetting groups respectively, and thus the power source and the controller controlling the power source can be simplified.

BRIEF DESCRIPTION OF THE DRAWINGS

FIG. 6 is a diagram showing a result of jetting experiment;

FIG. 7 is a diagram showing a result of another jetting experiment;

DESCRIPTION OF THE PREFERRED EMBODIMENTS

Figure 1:
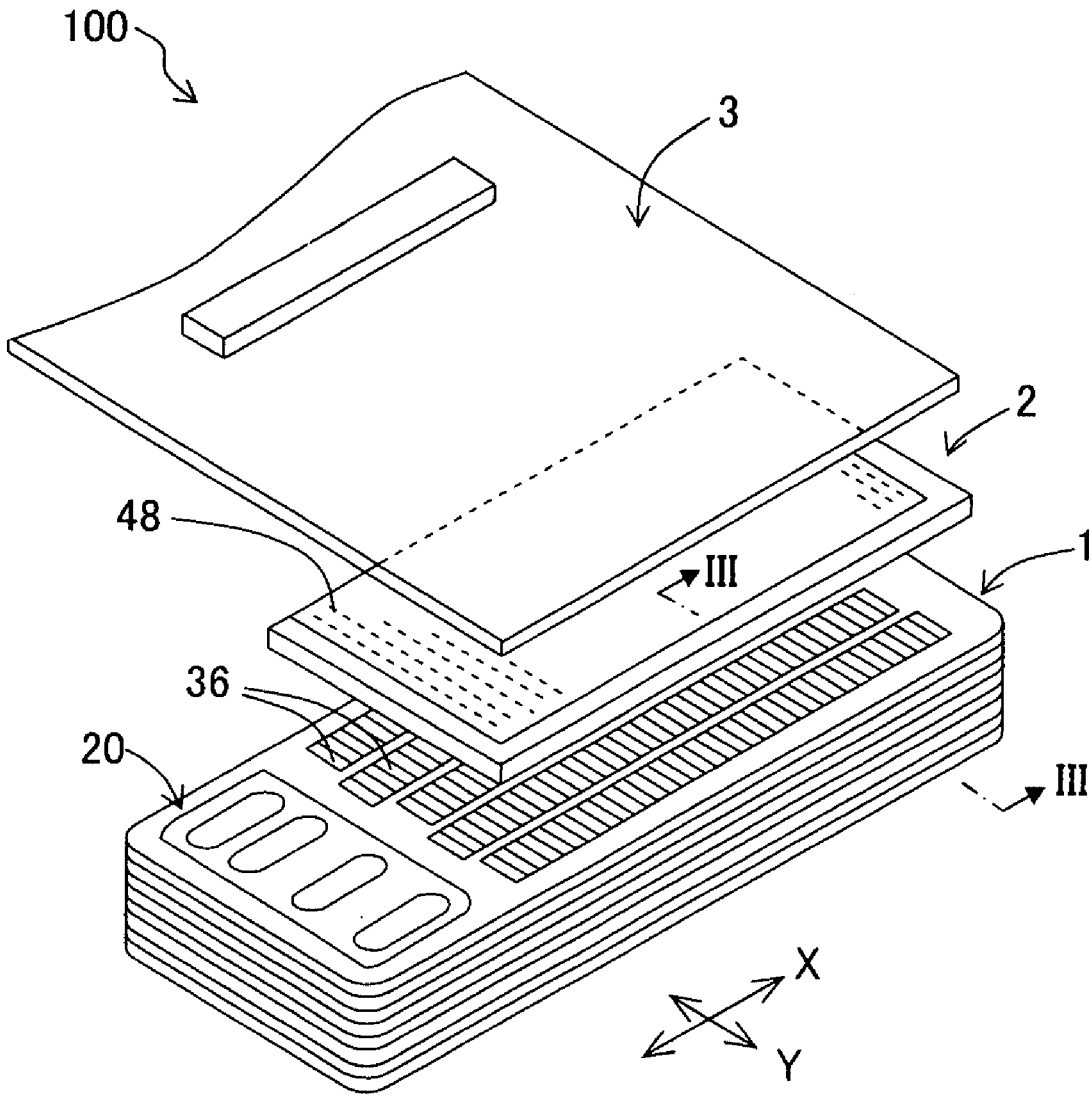
FIG. 1 is an exploded perspective view of an ink-jet head as a liquid-droplet jetting apparatus.

A basic embodiment of the present invention will be explained below using FIGS. 1 to 9. As shown in FIG. 9, an ink-jet printer 101 is provided with a carriage 102 which is movable in a scanning direction (left and right direction in FIG. 9); an ink-jet head 100 which is movable together with the carriage 102 and which jets inks onto a recording paper P; and paper transporting rollers 103 which transport (feed) the recording paper P in a paper feeding direction (direction toward forward portion in the sheet surface of FIG. 9). The ink-jet head 100 jets droplets of the inks (ink droplets) from nozzles 4 (see FIG. 3) arranged in a lower surface of the ink-jet head 100, while moving integrally with the carriage 102 in the scanning direction, thereby performing recording on the recording paper P. The recording paper P, on which the recording has been performed by the ink-jet head 100, is discharged by the paper transporting rollers 103 in the paper feeding direction.

FIG. 1 is an exploded perspective view of the ink-jet head 100 as an embodiment of the liquid-droplet jetting apparatus of the present invention. A plate-shaped piezoelectric actuator 2 is joined to a cavity unit 1 which is provided with a plurality of plates; and a flexible flat cable 3, for connecting the piezoelectric actuator 2 with an external device, is joined to the upper surface of the piezoelectric actuator 2. The inks are jetted downwardly from the nozzles 4 (see FIG. 3) which are open in the lower surface of the cavity unit 1.

Figure 2:
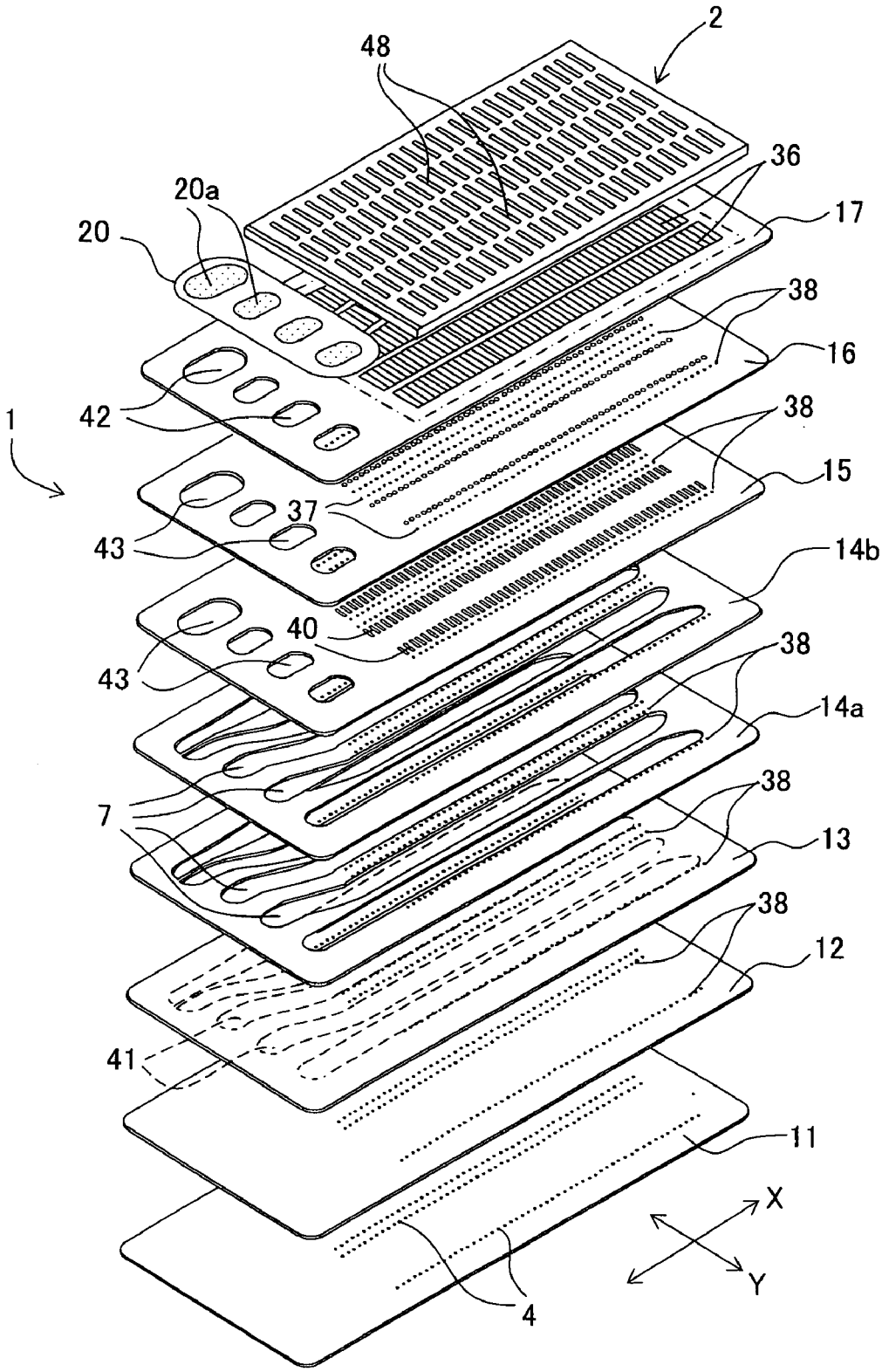
FIG. 2 is an exploded perspective view of a cavity unit.

As shown in FIG. 2, the cavity unit 1 is provided with eight thin plates which are a nozzle plate 11, a spacer plate 12, a damper plate 13, two manifold plates 14*a* and 14*b*, a supply plate 15, a base plate 16, and a cavity plate 17. The cavity unit 1 is constructed by stacking and adhering these plates together with an adhesive.

In the embodiment, the thickness of each of the plates 11 to 17 is about 40 to 150 μm. The nozzle plate 11 is formed of a synthetic resin such as polyimide, and each of the remaining plates other than the nozzle plate is formed of a 42% nickel alloy steel plate. A plurality of nozzles 4, arranged at a minute spacing distance, is formed in the nozzle plate 11. Each of the nozzles 4 has a diameter of about 17 to 21 μm. The nozzles 4 are aligned in five rows in a longitudinal direction (X direction) of the nozzle plate 11.

The ink-jet head 100 is capable of jetting four color inks which are a black ink (Bk), an yellow ink (Y), a magenta ink (M) and a cyan ink (C) to perform color recording. Five rows of the nozzles (nozzle rows) are formed in the ink-jet head 100. Nozzles belonging to each of the nozzle rows jet a same color ink among the color inks. Two of the nozzle rows are used for jetting the black ink, and each of the three remaining nozzle rows is used for jetting one of the remaining color inks (yellow, magenta and cyan inks).

Figure 3:
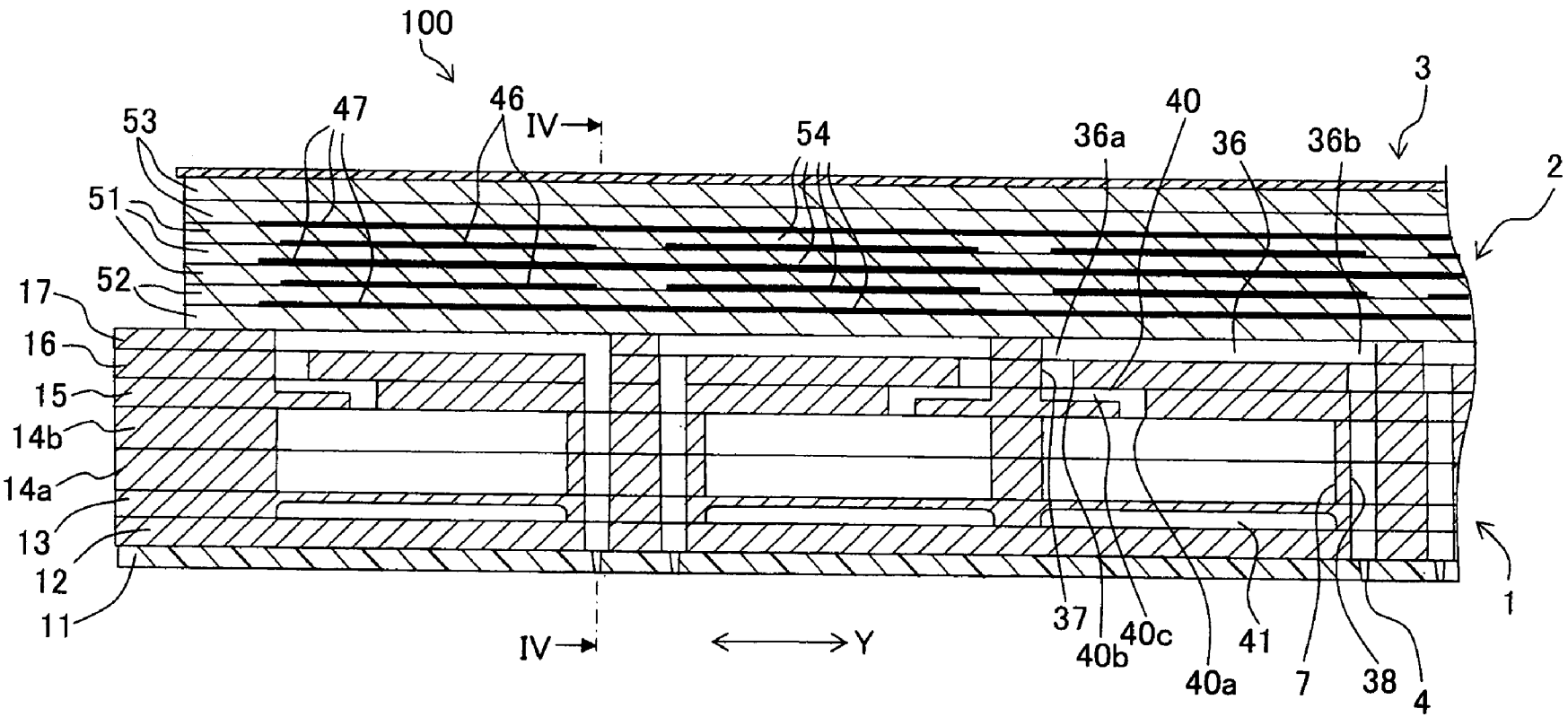
FIG. 3 is a cross-sectional view of FIG. 1 taken along a III-III line in FIG. 1.

As shown in FIG. 3, the nozzles 4 are communicated with a plurality of pressure chambers 36 formed in the cavity plate 17, via through passages 38, respectively. The through passages 38 are formed in the spacer plate 12, damper plate 13, two manifold plate 14*a* and 14*b*, supply plate 15 and base plate 16.

As shown in FIG. 2, the pressure chambers 36 are aligned, in the cavity plate 17, in five rows in the longitudinal direction (X direction, second direction) of the cavity plate 17. Each of the pressure chambers 36 is formed in an elongated shape, and a length of the pressure chambers 36 parallel to a direction in which the ink flows (ink-flow direction) is greater than a width, of the pressure chambers 36, orthogonal to the ink-flow direction. The longitudinal direction of the pressure chambers 36 is along the short direction (Y direction, first direction) of the cavity plate 17. Each of the pressure chambers 36 is formed as a through hole penetrating through the cavity plate 17. As shown in FIG. 3, each of the pressure chambers 36 is communicated with a common ink chamber 7 at an end 36*a*, of the pressure chamber 36, in the longitudinal direction thereof, via a communication hole 37 and a connection channel 40 as described later on. Each of the pressure chambers 36 is communicated with one of the through passages 38 at the other end 36*b*, of the pressure chamber 36, in the longitudinal direction thereof. Among the five pressure chamber rows, two pressure-chamber rows are used for the black ink and three pressure-chamber rows are used for the remaining three color inks respectively, corresponding to the allocation (designation) of the four color inks with respect to the nozzle rows.

Communication holes 37, each connected to the one end 36*a* of one of the pressure chambers 36, are formed in the base plate 16 arranged below the cavity plate 17. A plurality of connection channels 40, for supplying each of the inks from the common ink chamber 7 to the pressure chambers 36, is formed in the supply plate 15 arranged below the base plate 16. As shown in FIG. 3, an inlet hole (inflow hole) 40 from which the ink inflows from the common ink chamber 7, an outlet hole 40*b* which is open toward one of the communication holes 37, and a throttle 40*c* is formed in each of the connection channels 40. The throttle 40*c* is formed between the inlet and outlet holes to have a small cross-sectional area such that the channel resistance in the throttle 40*c* is greatest in each of the connection channels 40; and that, when the jetting pressure is applied to a pressure chamber 36 corresponding to the throttle 40*c*, the throttle 40*c* prevents the reverse flow of the ink toward the common ink chamber 7 and advances the ink efficiently toward a corresponding nozzle 4, thereby jetting the ink from the nozzle 4.

Five pieces of the common ink chamber (manifold chamber) 7 are formed in the two manifold plates 14*a*, 14*b*. Each of the common ink chambers 7 is elongated (extended) in the longitudinal direction (X direction) of the manifold plates 14*a* and 14*b*, and is formed as a through hole extending along one of the rows of the nozzles 4. As shown in FIG. 3, the five common ink chambers 7 are formed by stacking the two manifold plates 14 and 14*b*, and by covering the upper surface of the manifold plate 14*b* and the lower surface of the manifold plate 14*a* with the supply plate 15 and the damper plate 13, respectively. Each of the common ink chambers 7 overlaps with portions of the pressure chambers 36 in a plan view (as viewed in a stacking direction in which the plates are stacked), and extends along a row direction in which the pressure chambers 36 are aligned in a row (row direction of the nozzles 4).

As shown in FIGS. 2 and 3, at a side of the lower surface of the damper plate 13 arranged below the manifold plate 14*a*, damper chambers 41 isolated from the common ink chambers 7 are formed as recesses (dents). As shown in FIG. 2, the position and shape of each of the damper chambers 41 in a plan view are matched with one of the common ink chambers 7. Since the damper plate 3 is formed of an elastically deformable metallic material, each of the damper chambers 41 is capable of vibrating freely toward the common ink chamber 7 and toward the damper chamber 41 at a ceiling portion which is formed in a thin-plate shape in the upper portion of the damper chamber 41. Upon jetting the ink, even when a pressure fluctuation generated in a certain pressure chamber 36 is propagated to the common ink chamber 7, the ceiling portion elastically deforms and vibrates to function as a damper which absorbs and damps the pressure fluctuation (damper effect), thereby preventing a cross-talk which is a phenomenon that the pressure fluctuation in the certain pressure chamber 36 is propagated to another pressure chamber 36.

As shown in FIG. 2, four ink supply holes 42 are formed, in the cavity plate 17 at one end thereof in the short direction, as inlets for the inks to the cavity unit 1. Connection holes 43 are formed in each of the base plate 16 and the supply plate 15 at positions overlapping with the positions at which the four ink supply holes 42 are formed in the cavity plate 17, respectively. The inks supplied from an ink supply source are supplied to the common ink chambers 7 at one end in a longitudinal direction thereof, via the ink supply holes 42 and the connection holes 43, respectively. A filter body 20, having filtering parts 20*a* corresponding to the four ink supply holes 42 respectively, is adhered to the cavity plate 17 with an adhesive or the like such that the filter body 20 covers the four ink supply holes 42.

In this embodiment, five pieces of the common ink chambers 7 are provided while four pieces of the ink supply holes 42 and four pieces of the connection holes 43 are provided; and among the ink supply holes, an ink supply hole 42 located on the left end in FIG. 2 supplies an ink to two pieces of the common ink chambers 7. In the embodiment, the black ink is supplied to one of the ink supply holes 42 located at the left end and supplying the ink to the two common ink chambers 7, taking into consideration that the black ink is used more frequently than other color inks. The yellow ink, the magenta ink and the cyan ink are supplied to the remaining ink supply holes 42, respectively.

The piezoelectric actuator 2 as described above is provided with a plurality of ceramics layers each of which has a shape of a flat plate having a size capable of covering all the pressure chambers and which are stacked in a direction (thickness direction) orthogonal to a direction of a plane thereof (plane direction); and a plurality of electrodes (electrode layers) arranged on surfaces of the ceramics layers, similarly to a publicly known piezoelectric actuator disclosed, for example, in Japanese Patent Application Laid-open No. 2002-254634 or the like. In this embodiment, the ceramic actuator 2 is formed in the following manner. First, a mixture of ceramics powder, binder and solvent is formed in a shape of a sheet having a thickness of about 15 to 40 μm so as to obtain a plurality sheets made of piezoelectric ceramics material (green sheets). Electrodes are formed on a surface of the green sheets with a conductive paste by a printing method or the like. The green sheets after the electrodes are formed thereon are stacked and calcinated to thereby form the piezoelectric actuator 2.

The electrodes include drive electrodes (individual electrodes 46 formed corresponding to the pressure chambers 36, respectively, and common electrodes 47 each of which is formed to cover the pressure chambers 36) and surface electrodes 48. The individual electrodes 46 and the common electrodes 47 are arranged alternately in a direction in which the ceramics layers are stacked (stacking direction of the ceramic layers) so as to sandwich these ceramics layers therebetween. The surface electrodes 48 are arranged on the uppermost surface of the piezoelectric actuator 2 (on the side opposite to the cavity unit 2). The surface electrodes 48 are connected to the individual and common electrodes 46, 47 via electrical through holes (see FIG. 1) respectively, and each of the surface electrodes 48 is electrically connected to the flexible flat cable 3.

Figure 5:
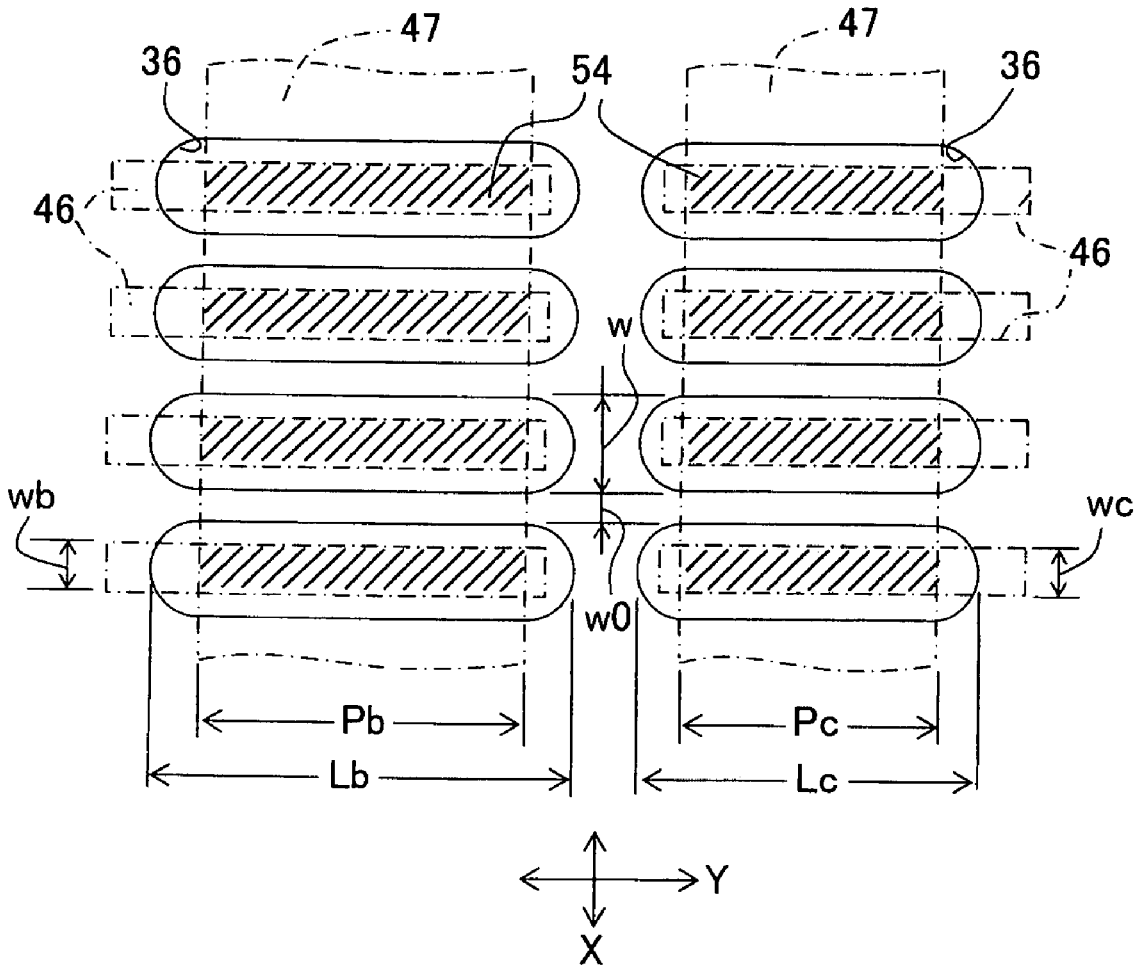
FIG. 5 is a view for explaining a positional relationship between pressure chambers and active portions.

In the piezoelectric actuator 2 in which electrodes are arranged in layers in such a manner, a high voltage is applied between the individual electrodes 46 and the common electrodes 47 in a publicly known manner, so as to polarize portions of the ceramics layer sandwiched between the individual and common electrodes, thereby forming these polarized ceramic portions as active portions 54 having a piezoelectric characteristic. In this embodiment, since the active portions 54 are formed in a plurality of ceramics layers (hereinafter referred to as "base piezoelectric layers 51") as will be described later, these active portions 54 are overlapped in a direction in which the piezoelectric layers are stacked (stacking direction of the piezoelectric layers). As shown in FIG. 5, each of the individual electrodes 46 has an elongated shape corresponding to the shape of one of the pressure chambers 36, and each of the common electrodes 47 is formed in a widely spread shape to cover a plurality of the pressure chambers 36. Accordingly, the shape of the active portions 54 stacked in multiple layers is the shape of portions at each of which the individual electrode 46 and the common electrode 47 are overlapped. In FIG. 5, the active portions 54 are indicated by hatching.

The ceramics layers includes the base piezoelectric layers 51 each having the active portions 54 formed therein, the active portions 54 being sandwiched by the individual electrodes 46 and the common electrodes 47 respectively; a bottom layer 52 arranged between the cavity unit 1 and a lowermost base piezoelectric layer 51 among the base piezoelectric layers 51 and including no active portions 54; and a top layer 53 arranged on an uppermost base piezoelectric layer 51, among the base piezoelectric layers 51, on a side thereof opposite to the cavity unit 1 and including no active portions 54.

Figure 4:
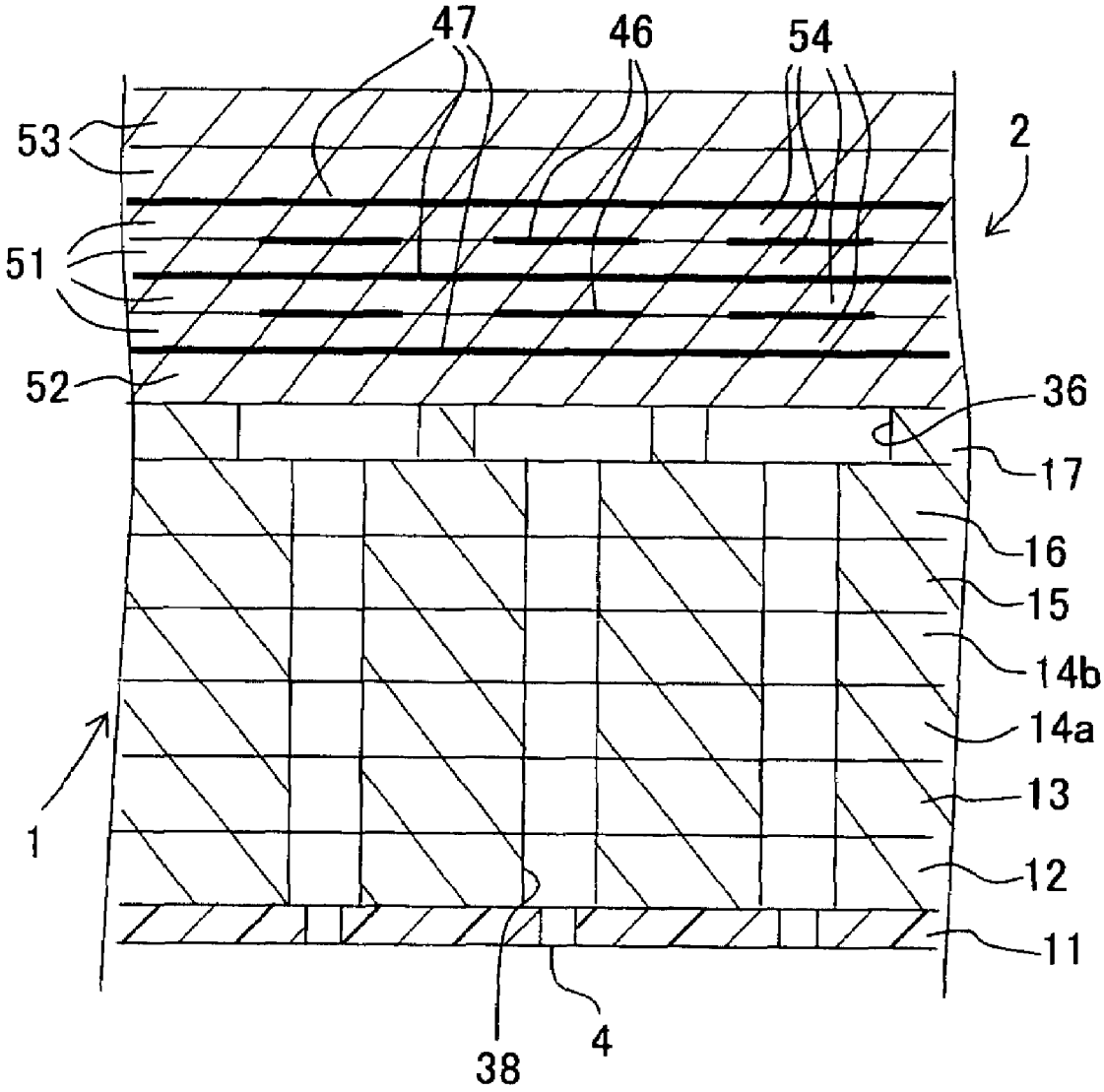
FIG. 4 is a cross-sectional view of FIG. 3 taken along a IV-IV line in FIG. 3.

The top layer 53 is provided for efficiently transmitting the displacement (deformation) of the active portions 54 to the side of the pressure chambers 36 by preventing the displacement of the active portions 54 from projecting toward the side opposite to the pressure chambers 36 (to the side of top layer 53). The bottom layer 52 is provided for preventing short-circuit between electrodes or the like which would be otherwise caused by the ink in the pressure chambers 36 permeating the piezoelectric actuator 2 covering the openings of the pressure chambers 36. In this embodiment, the plurality of base piezoelectric layers 51 and a plurality of top layers 53 are provided while only one bottom layer 52 is provided. FIG. 4 illustrates a piezoelectric actuator 2 constructed of four base piezoelectric layers 51, one bottom layer 52, and two top layers 53. Note that the term "one layer" used herein means a layer formed of one piece of the green sheet; and when, for example, two pieces of the green sheet are stacked and calcinated without sandwiching any electrode layer therebetween, and the two green sheets appear to be integrated, it is still considered that there are formed two layers.

The plate-type piezoelectric actuator 2 is overlaid on the cavity unit 1 be fixed to the cavity unit 1 with an adhesive or the like such that the stacking direction of the piezoelectric layers matches with the stacking directions of the piezoelectric actuator 2 and cavity unit 1. At this time, the individual electrodes 46 of the piezoelectric actuator 2 are arranged so as to overlap with the pressure chambers 36 formed in the cavity unit 1, respectively. The aforementioned flexible flat cable 3 (see FIG. 3) is joined to the upper surface of this piezoelectric actuator 2 so as to electrically connect pattern wirings (not shown) in this flexible flat cable 3 to the surface electrodes 48, respectively.

In the ink-jet head 100 of this embodiment, in order to arrange the nozzle highly densely, a nozzle pitch between nozzles (resolution in the X direction) is set to 75 dot per inch (dpi). The pressure chambers 36 are formed in the cavity plate 17 by a pitch corresponding to the nozzle pitch of 75 dpi. For the purpose of securing the stability upon producing the pressure chambers 36 in the cavity plate 17, it is desired that a width W (see FIG. 5) orthogonal to the ink-flow direction in the pressure chamber 36, is 260 μm±20 μm. In this case, in each of the pressure chamber rows, a spacing distance WO between adjacent pressure chambers 36 is about 80 μm. Note that the nozzles may be arranged further highly densely so that the nozzle pitch is greater than 75 dpi.

In the ink-jet head 100, the color inks (yellow, magenta and cyan inks) are mainly used to perform image recording, and the black inks is mainly used to perform text recording. There is a demand that a jetting amount in which one droplet of the black ink is jetted is to be made greater than a jetting amount in which one droplet of the color inks to thereby increase the recording speed. Further, in some cases, for the purpose of enhancing the sharpness of the text recording with the black ink and of increasing the vividness of the color ink, a pigment ink is used as the black ink and dye inks are used as the remaining three color inks other than the black ink. In such a case, the pigment ink has a property that the pigment ink hardly blurs on the recording medium as compared to the dye inks. Therefore, when the pigment ink and each of the dye inks are jetted in a same amount onto the recording medium to form a black dot of the black ink and color dots of the color inks, the dot of the pigment ink is formed to be smaller than the dots of the dye inks. Accordingly, in order to also improve the dot balance (recording quality) between the black ink as the pigment ink and the dye inks as the color inks, there is a demand to increase a jetting amount in which one droplet of the black ink is jetted than that of each of the dye inks.

To satisfy the demand, in the embodiment, the diameter of a nozzle 4 for the black ink is made to be greater than the diameter of a nozzle for the color ink, and the volume of a pressure chamber 36 for the black ink is made to be greater than the volume of a pressure chamber 36 for the color ink. Here, the diameter of the nozzle for black ink is 20.5 μm and the diameter of the nozzle for color ink is 17.0 μm.

The width of the pressure chambers 36 is defined to maintain the aforementioned nozzle pitch of 75 dpi, and the depth of the pressure chambers 36 is defined by the thickness, of the cavity plate 17, which is uniform. However, since the pressure chamber 36 for the black ink is formed to have a length, in the longitudinal direction thereof, greater than that of the pressure chamber 36 for each of the color inks, the volume of the pressure chamber 36 for the black ink is greater than that of the pressure chamber 36 for the color ink. Specifically, a length Lb of the pressure chamber 36 for the black ink is 1.4±0.1 mm to 1.5±0.1 mm (hereinafter referred to as "1.4 mm"); and a length Lc of the pressure chambers 36 for the color inks other than black (yellow, magenta and cyan inks) is 1.1±0.1 mm to 1.2±0.1 mm (hereinafter referred to as "1.1 mm").

To transmit the deformation (displacement) of the active portions 54 effectively to the pressure chambers 36, the active portions 54 are formed to have a shape slightly smaller than that of the pressure chambers 36 (see FIG. 5). To correspond to the difference in length between the pressure chamber 36 for the black ink and the pressure chambers 36 for the color inks, active portions 54 for the black ink are formed to be longer than active portions 54 for the color inks. Here, a length Pb of active portions 54 for the black ink is 1.2 mm, and a length Pc for active portions of the color inks other than the black ink is 0.9 mm (Pb>Pc).

Upon determining the width of the active portions 54, the inventor of the present invention performed a jetting experiment by using ink-jet heads in each of which a width Wb of the active portions 54 for the black ink and a width Wc of the active portions 54 for the color inks are 160 μm (Wb=Wc=160 μm), whereas the length of the active portions 54 for the black ink and the length of the active portions 54 for the color inks are different. FIG. 6 shows a result of the jetting experiment.

In the jetting experiment, with respect to 16 pieces of the ink-jet heads 100 (heads No. 1 to No. 16), an investigation was made about a drive voltage required for active portions 54 for the black ink to jet a droplet of the black ink (indicated as "Bk" in the drawing) at a predetermined speed (9 m/s) and a drive voltage required for active portions 54 for a color ink to jet a droplet of the color ink (indicated as "CL" in the drawing) at the predetermined speed (9 m/s). FIG. 6 indicates, in a column labeled as "voltage difference", a difference between the drive voltage for the active portions 54 for the black ink and the drive voltage for the active portions 54 for the color ink. As the result of the experiment, it was revealed that average voltage difference among the sixteen pieces of the ink-jet heads 100 is 0.6 V. In this manner, when the width of the active portions 54 for the black ink and the width of the active portions 54 for the color ink are made to be the same, the voltage difference is 0.6 V. Therefore, in a controller (driver IC or the like, not shown in the drawings) which controls the drive voltages, there is a need to set the drive voltage for the black ink and the drive voltage for the color ink separately in advance, which in turn leads to the increased cost for the controller.

In view of the above situation, the inventor of the present invention made not only the length but also the width to be different between the active portions 54 for the black ink and the active portions 54 for the color ink, and performed another experiment similar to the aforementioned experiment. As a result of the another experiment, it was confirmed that drive voltages applied to the active portions 54 for the black ink and the active portions 54 for the color ink were substantially same by making the width Wb of the active portions 54 for the black ink to be 160 μm and by making the width Wc of the active portions 54 for the color ink to be 154 μm. FIG. 7 shows the result of this experiment. Note that the lengths of the active portions 54 in this experiment are same to those of the active portions 54 in the experiment shown in FIG. 6. FIG. 7 shows the result of measurement performed with respect to 26 pieces of the ink-jet head 100. In a case that droplets of the black and the color ink are jetted at a predetermined speed (9 m/s), the average difference between the drive voltage for the black ink and the drive voltage for the color ink was 0.1 V. Since the voltage difference is small, the ink droplets of the black and color inks can be jetted at a same jetting speed even when the drive voltages for the black and color inks set in advance in the controller are the same for the black and color inks.

Namely, even when the jetting amount per one droplet of the black ink is to be made greater than the jetting amount per one droplet of the other color ink(s), the width of the active portions 54 (for the black ink), which have a greater length than that of the active portions 54 (for the color ink or inks), are made to be greater than the width of the active portions 54 (for the color ink or inks) which have a shorter length that that of the active portions 54 for the black ink. This makes it possible to drive all the active portions 54 by a same drive voltage and to jet the liquids droplets of the black and color inks at a same jetting speed.

When the cavity unit 1 is joined (assembled) to the piezoelectric actuator 2, in some cases, during the assembly, the pressure chambers 36 are arranged at positions deviated from the position at which the active portions 54 are arranged. If an amount by which the positions of the pressure chambers 36 are deviated from those of the active portions 54 is great, the displacement of the active portions 54 is not efficiently transmitted to the pressure chambers 36, resulting in a phenomena that the droplets of the inks are jetted only at a speed lower than the predetermined speed.

Figure 8:
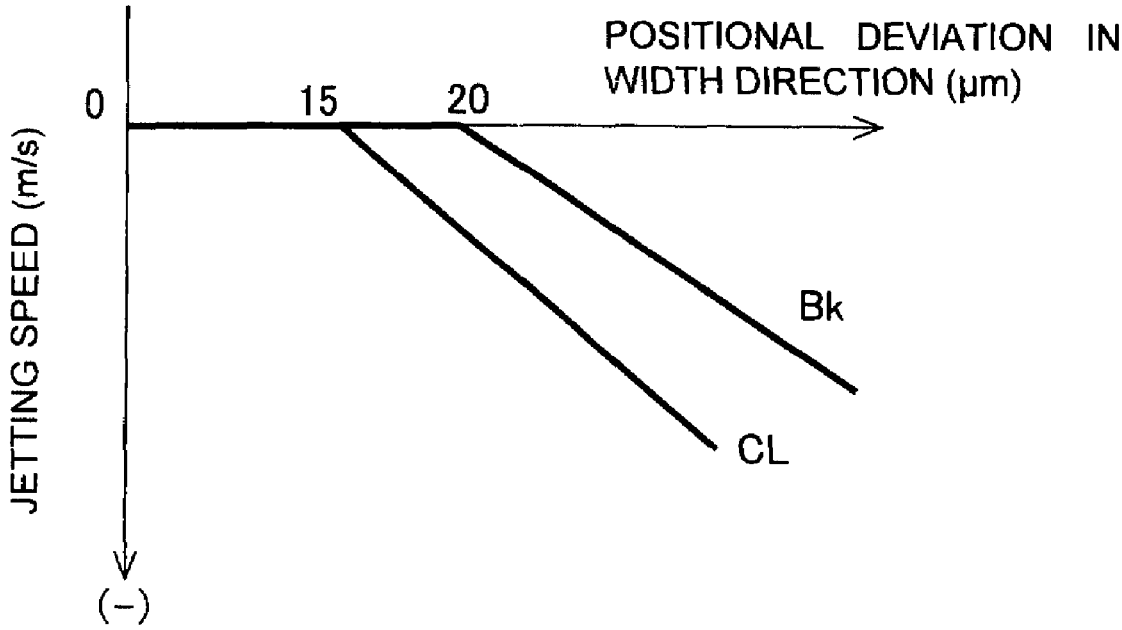
FIG. 8 is a diagram showing decrease in the jetting speed with respect to positional deviation amount.
Figure 9:
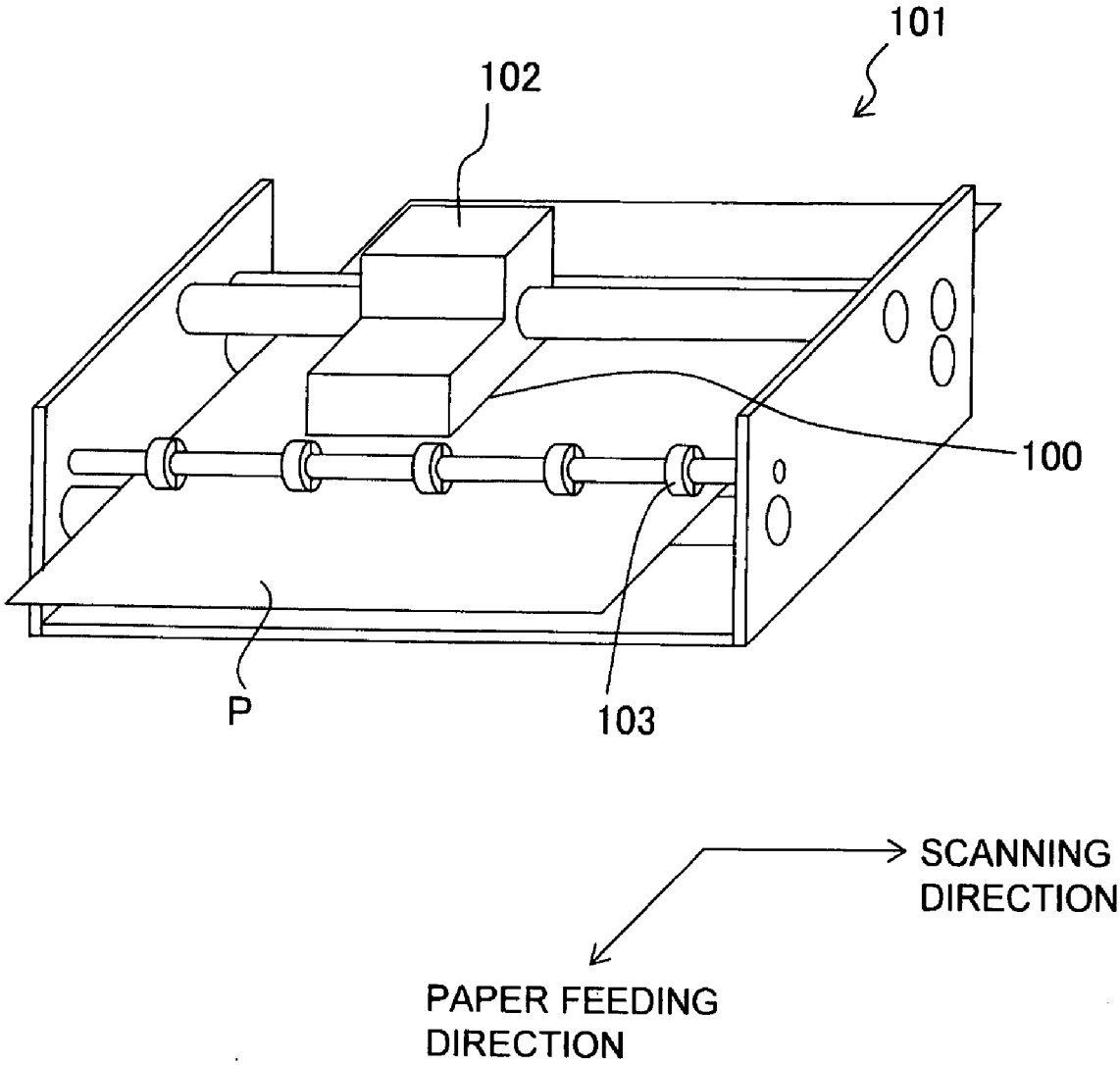
FIG. 9 is a diagram showing an ink-jet printer including an ink-jet head as the liquid-droplet jetting apparatus of the present invention.

According to an experiment conducted by the inventor of the present invention, when the active portions 54 for the black ink have a greater length than that of the active portions 54 for the color inks but are same in width with the active portions 54 for the color ink, then as shown in FIG. 8, the decrease in the jetting speed relative to the positional deviation in the width direction of the active portion 54 affects more sensitively on the active portions 54 for the color ink than the active portions 54 for the black ink, probably for the following reason. That is, the area of the active portions 54 for the color ink is smaller than the area of the active portion 54 for the black ink, and the active portions 54 for the color ink are displaced by energy smaller than the displacement energy for the active portions 54 for the black ink. Therefore, even when the active portions for the black and color inks are deviated by a same deviation amount, the droplets of the color ink are affected by the positional deviation more greatly than the droplets of the black ink.

When the width of the active portions 54 for the color ink is made narrower than the width of the active portions 54 for the black ink, namely, the width of the shorter active portions 54 is made to be narrower than the width of the longer active portions 54, then it is possible to obtain an effect to dull the sensitivity to the lowering of the jetting speed with respect to the positional deviation in the width direction, in addition to the aforementioned effect that the drive voltages can be made same both for the active portions for the black ink and the active portions for the color inks. Accordingly, even if a positional deviation occurs when the cavity unit 1 is joined to the piezoelectric actuator 2, it is possible to suppress the variation in the jetting characteristics among the black and the color inks other than the black ink.

Although the embodiment is exemplified by an ink-jet head which jets inks, the present invention is applicable also to an apparatus which jets coloring liquids to a medium, an apparatus which forms a thin film on a medium, an apparatus which jets a single liquid or a plurality of liquids quantitatively (by a predetermined amount), or the like.

In the embodiment, the active portions (and the pressure chambers and nozzles corresponding to the active portions, respectively) are grouped into two jetting groups (first jetting group and second jetting group) in accordance with the color of the inks jetted (difference in the jetting amounts), and the length and width of the active portions 54 are determined for each of the jetting groups such that all the jetting groups perform jetting at a same jetting speed and by a same drive voltage. However, a manner of grouping the active portions into the jetting groups is not limited to the color of the liquids, and it is also allowable that the grouping is made, depending on the purpose, with respect to other property of the liquids (for example, surface tension, viscosity and/or the like). Alternatively, the grouping may be performed based on the difference in the jetting conditions such as the nozzle diameter, jetting speed, jetting amount and/or the like. For example, different jetting speeds can be set for different jetting groups, respectively. Alternatively, the jetting groups may be grouped by the difference in the property, and the setting may be made so that the jetting amounts are the same between the groups.

What is claimed is:

1. A liquid-droplet jetting apparatus which jets droplets of liquids onto an object, the apparatus comprising:

a cavity unit having a plurality of nozzles, and a plurality of pressure chambers which correspond to the nozzles respectively and which are elongated in a first direction; and a piezoelectric actuator stacked on the cavity unit to cover the pressure chambers, and having a plurality of active portions which are arranged corresponding to the pressure chambers respectively, which change volume of the pressure chambers respectively by being applied with a predetermined drive voltage, and which are elongated in the first direction;

wherein the active portions, the nozzles and the pressure chambers are grouped into a first jetting group and a second jetting group;

an active portion, among the active portions, included in the first jetting group has a length in the first direction which is greater than that of another active portion included in the second jetting group, and has a length in a second direction, orthogonal to the first direction, which is greater than that of the another active portion included in the second jetting group; and a drive voltage applied to the active portion included in the first jetting group is same as a drive voltage applied to the another active portion included in the second jetting group.

2. The liquid-droplet jetting apparatus according to claim 1, wherein a property of a liquid, among the liquids, jetted from the first jetting group and a property of another liquid, among the liquids, jetted from the second jetting group are different.

3. The liquid-droplet jetting apparatus according to claim 1, wherein the first jetting group and the second jetting group have mutually different jetting conditions.

4. The liquid-droplet jetting apparatus according to claim 1, wherein a nozzle, among the nozzles, belonging to the first jetting group jets a liquid, among the liquids, at a speed substantially same with a speed at which another liquid, among the liquids, is jetted from another nozzle belonging to the second jetting group.

5. The liquid-droplet jetting apparatus according to claim 1, wherein the first and second jetting groups are set to jet the liquids in different jetting amounts respectively; and an active portion, among the active portions, belonging to one of the first and second jetting groups which performs jetting in a greater jetting amount among the jetting amounts, has the length in the first direction and the length in the second direction greater than those of another active portion belonging to the other of the first and second jetting groups which performs the jetting in a smaller jetting amount among the jetting amounts.

6. The liquid-droplet jetting apparatus according to claim 5, wherein a diameter of a nozzle, among the nozzles, belonging to one of the first and second jetting groups which performs the jetting in the greater amount, is greater than a diameter of another nozzle belonging to the other of the first and second jetting groups which performs the jetting in the smaller jetting amount.

7. The liquid-droplet jetting apparatus according to claim 5, wherein a liquid, among the liquids, jetted from a nozzle among the nozzles belonging to one of the first and second jetting groups which performs the jetting in the greater jetting amount, is a pigment ink; and another liquid, among the liquids, jetted from another nozzle belonging to the other of the first and second jetting groups which performs the jetting in the smaller jetting amount, is a dye ink.

8. The liquid-droplet jetting apparatus according to claim 7, wherein the pigment ink is a black ink, and the dye ink is a color ink.

9. The liquid-droplet jetting apparatus according to claim 1, wherein the piezoelectric actuator has a plurality of stacked piezoelectric layers.

10. The liquid-droplet jetting apparatus according to claim 1, wherein a length in the first direction of a pressure chamber, among the pressure chambers, belonging to the first jetting group is greater than that of another pressure chamber belonging to the second jetting group.

11. The liquid-droplet jetting apparatus according to claim 1, which is an ink-jet head which jets droplets of inks.

* * * * *